United States Patent [19]

Bridges et al.

[11] Patent Number: 4,570,144

[45] Date of Patent: Feb. 11, 1986

[54] THERMALLY ACTUATED VARIABLE-RATING CIRCUIT BREAKER HAVING ADJUSTABLE HEAT SINK MEANS

[75] Inventors: Robert B. Bridges, Elm Grove; John R. Brubaker, Milwaukee; Jerome K. Hastings, Sussex; John W. Kroll, Greendale, all of Wis.

[73] Assignee: Eaton Corporation, Cleveland, Ohio

[21] Appl. No.: 648,203

[22] Filed: Sep. 7, 1984

[51] Int. Cl.[4] ..... H01H 61/00; H01H 75/08

[52] U.S. Cl. ..... 337/88; 335/45; 337/82

[58] Field of Search ..... 337/68, 75, 77, 81, 337/82, 85, 88, 102, 103, 104, 113, 35, 38, 40, 41, 45, 47, 257, 258; 335/43, 45

[56] References Cited

U.S. PATENT DOCUMENTS 2,839,633 6/1958 Moyer ..... 337/82

2,910,561 10/1959 Frey et al. ..... 337/88

*Primary Examiner*—Harold Broome

*Attorney, Agent, or Firm*—C. H. Grace; L. G. Vande Zande

[57] ABSTRACT

A heater strip (12) is disposed in spaced relation to a temperature responsive actuator element (20) for indirectly heating that element in response to current flow in the heater (12). An adjustable heat sink (22) is disposed in spaced proximity to the actuator element (20) for removing heat from the actuator element by radiation therefrom through air to the heat sink in a first position and adjustable to be in thermally conductive engagement with the actuator in a second position for increasing the efficiency of heat transfer from the actuator to the heat sink. Increased current flow in the protected branch circuit is required to cause the actuator (20) to attain its predetermined actuation temperature as the heat sink is adjusted to increase the efficiency of heat transfer between the actuator (20) and the heat sink.

5 Claims, 1 Drawing Figure

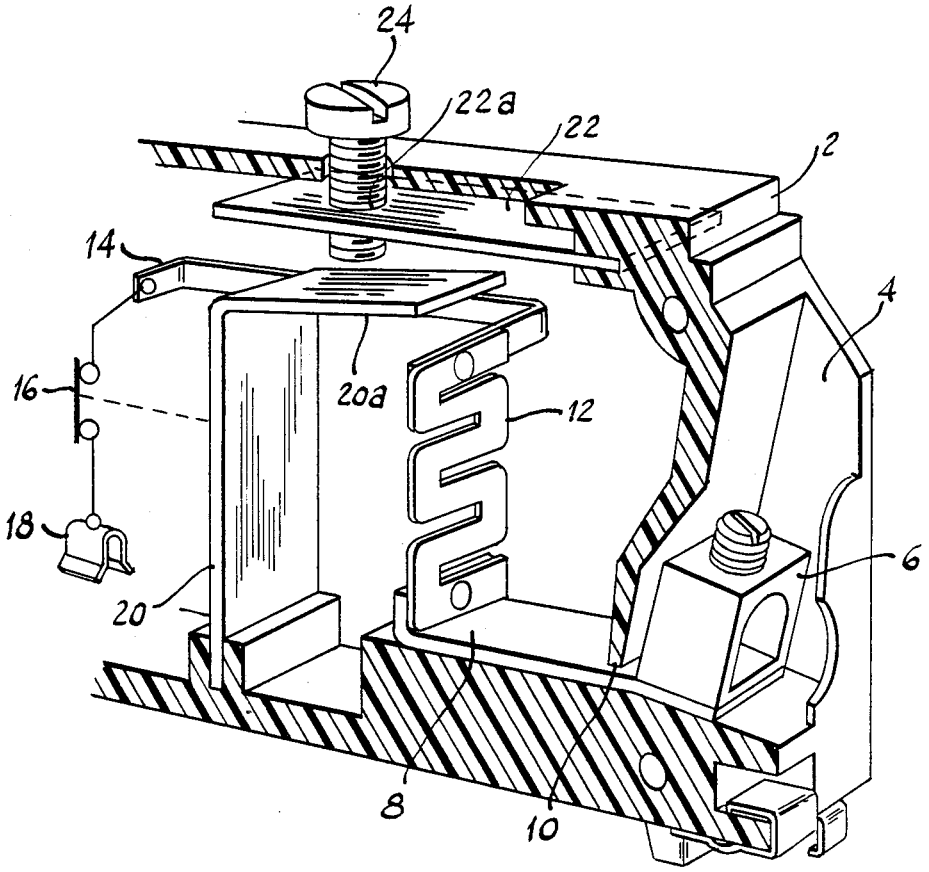
24
22a
22
2
14
4
16
20a
12
18
6
20
8
10

THERMALLY ACTUATED VARIABLE-RATING CIRCUIT BREAKER HAVING ADJUSTABLE HEAT SINK MEANS

CROSS-REFERENCE TO RELATED APPLICATIONS

This invention is related to the disclosures in co-pending applications Ser. No. 648,205 filed Sept. 7, 1984 by Bruce Beihoff et al entitled Thermally Actuated Variable-Rating Circuit Breaker Having Adjustable Thermal barrier, and Ser. No. 648,204 filed Sept. 7, 1984 by Robert B. Bridges et al entitled Thermally Actuated Variable-Rating Circuit Breaker Having Selectively Connectable Heater elements, assigned to the assignee of this invention.

BACKGROUND OF THE INVENTION

This invention relates to molded case circuit breakers of the residential and commercial frame type. More particularly, the invention relates to circuit breakers of the aforementioned type which are thermally actuated to cause separation of the circuit breaker contacts.

Residential and commercial frame circuit breakers are utilized in panelboards and load centers for protecting branch lighting and appliance circuits. Circuit breakers of this type are availatle in various ampere ratings, the most common being 15 and 20 ampere rated breakers. Commonly, breakers of the two ratings are structurally the same but utilize thermal trip elements having different operating characteristics. Accordingly, the manufacturer provides and the distributor stocks two distinct breakers to accommodate both the 15 amp and 20 amp ratings, which results in a substantial inventory for both.

SUMMARY OF THE INVENTION

This invention provides a circuit breaker having an adjustable thermal trip structure whereby the same breaker may be adjusted and used for either of two distinct ampere ratings as desired. The breaker comprises a current responsive heater element which is electrically connected in the branch circuit to be protected for indirectly heating a thermally responsive contact actuator. A heat sink is provided in spaced relation to the thermally responsive contact actuator for removing heat from that actuator, and is adjustable to vary the spacing between the heat sink and the actuator and to ultimately make intimate contact with the actuator for increasing the efficiency of the heat sink. The invention and its advantages will be more clearly understood when reading the following description and claims in conjunction with the drawing.

BRIEF DESCRIPTION OF THE DRAWING

The single FIGURE of the drawing shows a fragmentary portion of a circuit breaker partially in perspective and partially in schematic constructed in accordance with this invention.

DESCRIPTION OF THE PREFERRED EMBODIMENT

This inventon is embodied in a narrow width molded case residential and commercial frame circuit breaker of the type disclosed in M. F. Koenig et al, U.S. Pat. No. 3,081,386 issued Mar. 12, 1963. A molded housing 2 has a pocket 4 at one end thereof which receives a pressure type wiring terminal 6 therein. A connector strap 8 is electrically attached to connector 6 and extends interiorly of the housing 2 through a slot 10 provided in an endwall of the housing. A heater element 12 is mounted at one end to the interior end of connector strap 8 in electrically conductive engagement with the strap. The opposite end of heater 12 is electrically connected to a connector strap 14 which extends along an interior sidewall of housing 2 and is electrically connected to one side of separable contacts 16 of the circuit breaker. The opposite side of the circuit breaker contacts 16 is connected to a terminal member 18 of the circuit breaker which may be of the plug-in or bolt-on type commonly known in circuit breaker art.

A temperature responsive actuator element 20 is mounted within the breaker housing 2 in spaced relation to the heater 12. The element 20 is preferably formed of a material which responds to a predetermined temperature by deflecting or changing from its original position, such as a bi-metal material or a shape memory effect alloy. In the embodiment depicted in the drawing, the element 20 is arranged to deflect leftward upon attaining the predetermined temperature to effect separation of contacts 16. The separation of the contacts may be directly effected by the actuator element or may be effected through an intermediate trip mechanism well known in the circuit breaker art. The heater element 12 indirectly heats the actuator element 20 to cause it to attain the required predetermined temperature for contact actuation.

According to one embodiment of this invention, the actuator element 20 is provided with a horizontally extending leg **20*a* at the upper end thereof. A heat sink member 22 is mounted in cantilevered fashion within the circuit breaker housing 2 to extend along the interior of the upper wall of the housing 2. An adjustment screw 24 extends through an opening in the upper wall of the housing 2 and threadably engages within an opening 22*a* within heat sink 22. The heat sink 22 is positioned in spaced proximity to the horizontal extension 20*a* of temperature responsive actuator element 20 to receive heat radiated from the actuator element 20 through the heat transfer medium of air. The efficiency of the heat transfer may be increased by turning adjusting screw 24 such that it linearly advances through the hole 22*a* to move into engagement with extension 20*a* of actuator element 20. In so doing, heat from actuator 20 is directly transferred to heat sink 22 through the thermally conductive engagement of screw 24 with both the heat sink 22 and the extension 20*a* of actuator element 20**.

In operation, the circuit breaker is connected in a branch circuit which is to be protected thereby by connecting terminal 18 and terminal 6 into that circuit. Current flowing in that circuit will cause heater 12 to generate heat in proportion to the current. Heat generated by heater 12 will radiate to temperature responsive actuator element 20 to increase the temperature thereof toward the predetermined temperature necessary for effecting contact separation. However, a portion of the heat received by actuator 20 is given off to the heat sink 22, either by radiation through air or by direct thermal engagement according to the adjustment of screw 24. Thus, the net increase in temperature of actuator 20 is determined by the amount of heat received from heater 12 and the amount of heat given off to heat sink 22. For the less efficient adjustment wherein heat is radiated through air from extension **20*a* to heat sink 22, a lesser amount of current is required in the circuit to generate adequate heat for raising the temperature of actuator 20 to the predetermined temperature. When the heat sink is adjusted to be in thermal engagement with the actuator 20, more heat is required to be generated by heater 12 to raise the temperature of actuator 20 to the predetermined temperature, thereby requiring greater current flow in the protective circuit to effect contact separation. Accordingly, a 15 amp level of current may effect contact separation through actuator 20 when the screw 24 is adjusted to be out of contact with extension 20***a*, whereby a 20 amp current level may be required in the protective circuit to effect the same actuation of actuator 20 when the screw 24 is adjusted to be in thermally conductive engagement with the portion 20*a* of actuator 20.

The adjustment feature has been described as causing the screw 24 to move downwardly into engagement with portion 20*a* of actuator element 20, but in another embodiment of this invention screw 24 could alternatively be threadably received within the opening in the upper wall of housing 2 to bear against a surface of heat sink 22. Rotation of screw 24 could then cause heat sink 22 to be deflected into progressively closer proximity and ultimately into thermally conductive engagement with extension 20*a* of element 20. This arrangement provides a linear adjustment of current ratings as opposed to the step-change in ratings associated with the first described embodiment. Moreover, the 15 and 20 ampere ratings used in the description are merely exemplary, and the invention is not intended to be limited to then specific values. It is to be understood that the breaker is susceptible to these and other modifications without departing from the scope of the appended claims.

We claim:

1. A variable-rating circuit breaker comprising:

a current responsive heater electrically connected in circuit with separable contacts of said circuit breaker;

a temperature responsive actuator for effecting separation of said contacts in response to attaining a predetermined temperature; and means for selecting different current levels at which said actuator will effect separation of said contacts comprising:

a heat sink disposed in spaced proximity to said actuator for receiving radiated heat therefrom; and adjustment means for incrementally reducing said spaced proximity of said heat sink to said actuator for increasing quantities of heat removed from said actuator and increasing current levels required for effecting actuation of said actuator.

2. The invention defined in claim 1 wherein said adjustment means is operable to move said heat sink into thermal contact with said actuator for effecting direct conduction of heat from said actuator to said heat sink.

3. A variable-rating circuit breaker comprising:

a current responsive heater electrically connected in circuit with separable contacts of said circuit breaker;

a temperature responsive actuator for effecting separation of said contacts in response to attaining a predetermined temperature; and a heat sink disposed in proximity to said actuator and adjustable for selectively removing different quantities of heat from said actuator whereby selectively different current levels are required for effecting actuation of said actuator, said heat sink comprising a first member positioned in spaced relation to said actuator for receiving radiated heat from said actuator and a second member selectively adjustable for effecting thermal contact between said actuator and said first member.

4. The invention defined in claim 3 wherein said second member comprises a screw threadably received in said first member and adjustable to bear upon said actuator.

5. A variable-rating circuit breaker comprising:

a current responsive heater electrically connected in circuit with separable contacts of said circuit breaker;

a temperature responsive actuator for effecting separation of said contacts in response to attaining a predetermined temperature; and a heat sink mounted in spaced relation to said actuator for removing heat therefrom, said heat sink being adjustable to thermally contact said actuator for selectively removing a different quantity of heat therefrom whereby selectively different current levels are required for effecting actuation of said actuator, and wherein screw means provide adjustment of said heat sink for effecting thermal contact of said heat sink with said actuator.

* * * * *